US005904006A

United States Patent [19]

Evans

[11] Patent Number: 5,904,006

[45] Date of Patent: May 18, 1999

[54] CONSTRUCTION MODULE, PANEL AND SYSTEM

[75] Inventor: Ronald James Evans, Marrawah, Australia

[73] Assignee: Keith Ashley Sutton, Petersham, Australia

[21] Appl. No.: 08/727,561

[22] PCT Filed: Apr. 21, 1995

[86] PCT No.: PCT/AU95/00238

§ 371 Date: Oct. 21, 1996

§ 102(e) Date: Oct. 21, 1996

[87] PCT Pub. No.: WO95/29305

PCT Pub. Date: Nov. 2, 1995

[30] Foreign Application Priority Data

Apr. 22, 1994 [AU] Australia ..... PM5253

[51] Int. Cl.[6] ..... E04B 7/08

[52] U.S. Cl. ..... 52/81.4; 52/81.5; 52/DIG. 10; 52/80.1

[58] Field of Search ..... 52/80.1, 80.2, 52/81.4, 81.5, DIG. 10, 8, 82

[56] References Cited

U.S. PATENT DOCUMENTS

| | | | |
|---|---|---|---|
| 3,557,501 | 1/1971 | Kolozsvary | 52/81 |
| 3,568,381 | 3/1971 | Hale | 52/81 |
| 3,774,358 | 11/1973 | Hale | 52/81.4 |
| 3,914,486 | 10/1975 | Borgford | 428/73 |
| 3,925,941 | 12/1975 | Pearce | 52/81.4 X |
| 3,931,697 | 1/1976 | Pearce | 52/80 |
| 4,227,334 | 10/1980 | Hooker | 52/81.4 X |
| 4,359,842 | 11/1982 | Hooker | 52/18 |
| 4,723,382 | 2/1988 | Lalvani | 52/81 |
| 5,036,635 | 8/1991 | Lalvani | 52/8 |

FOREIGN PATENT DOCUMENTS

| | | | |
|---|---|---|---|
| 257603 | 5/1960 | Australia . | |
| 0405024 | 1/1991 | European Pat. Off. | E04C 2/32 |
| 2339950 | 2/1975 | Germany . | |
| WO87042 | 6/1987 | WIPO | E04B 7/10 |

OTHER PUBLICATIONS

Quarmby, Arthur, The Plastics Architect, Pall Mall Press 5 Cromwell Place, London sw 7, England © 1974, 11 pages.

*Primary Examiner*—Beth Aubrey
*Attorney, Agent, or Firm*—Charles E. Temko

[57] ABSTRACT

A module for a construction system is disclosed which can be used to form building panels and three-dimensional structures that may include self-supporting cladding. In one form the basic module (10, FIG. 1A, drawing [e]) is formed from two pleated hexagonal plates (11*a* and 14*a*) joined together at their peripheries with their concave sides together and with the ridges on one opposite the valleys of the other. Each plate is formed from a blank (11 and 14, respectively) which is a hexagon distorted by extending the radii which will form the valleys of the plate with respect to the radii of a regular hexagon (drawings [a] and [b]).

16 Claims, 10 Drawing Sheets

CONSTRUCTION MODULE, PANEL AND SYSTEM

TECHNICAL FIELD

This invention relates to polygonal construction modules which combine structural and cladding properties. It is concerned with two-dimensional construction panels—as might be used for weather-proof roots or walls—formed by joining a plurality of such modules edge-to-edge. It also relates to fully or partially cladded three-dimensional structures formed from a plurality of such panels. The modules of particular interest are those of hexagonal, octagonal, square or rectangular shape, but the panels and structures formed using these modules may also incorporate other modular elements. The invention is also concerned with construction systems using the modules and panels.

The modules, panels and construction systems of this invention may be employed in a wide range of applications, such as: for the construction of temporary or permanent housing, sheds, barns, garages, huts and the like; for the construction of self-supporting greenhouses, patio covers, awnings, shades, temporary weather shields and the like; for internal linings, partitions, display panels and the like; and for use in recreation as toys, construction kits, cubby-houses, play-ground structures and the like.

BACKGROUND OF THE INVENTION

Many construction systems based on frame structures with tetrahedral, hexagonal and/or octagonal modules have been proposed and used. For example, Australian Patent No 475,424 discloses a geodesic space-frame structure of icosahedral shape having pentagonal and hexagonal modules. These modules were themselves formed from isosceles triangles so that the dome-like structure could be cladded with triangular-shaped sheet-material modules. While such geodesic structures (as pioneered by the American inventor Richard Buckmainster Fuller) are essentially dome-like, a great variety of strut-and-node space-frames based on tetrahedral, hexahedral, and octahedral modules are also known and widely used (see, for example Australian patent No 460,682). These are also commonly clad with sheet-material panels of similar modular polygonal shapes, but the cladding panels rarely contribute to the load-bearing capacity of the structure and are not self-supporting.

English architect Arthur Quarmby, and others following his lead (eg, U.S. Pat. No. 4,359,842 to Hooker), proposed a variety of self-supporting structures formed by the pleating or folding of large sheets of material, typically glass-reinforced plastic. Many examples were offered in his book "The Plastics Architect" published by Pall Mall Press, London, 1975. Full structures were formed by unfolding large sheets on-site to form vaults, domes or hutments complete with roofs and walls, the erection process being much like the expansion of bellows. Such structures were tailored individually for their sites and folded for transport. However, the large sheets of material could not be dismantled into smaller modules or components for transport so that, for all but the smallest buildings, on-site construction of the sheets was essential thereby eliminating the advantage of factory production.

U.S. Pat. No. 3,914,486 to Borgford discloses the production of construction panels by pressing a modular hexagonal pattern into a large plate, but such large plates are expensive to press and difficult to handle and transport. U.S. Pat. No. 3,931,697 to Pearce, on the other hand, discloses the use of six different polygonal molecules to form domes and curved structures. The module of most relevance here is a radially pleated, 'minimal surface' hexagon in which ridges and valleys do not alternate so that bilateral skewing or 'saddling' results. These asymmetric modules are difficult to assemble into structures (requiring five other module types) and cannot be joined together in planar panels, as required for the walls of common rectangular buildings.

U.S. Pat. No. 4,723,382 (and the continuations hereof) to Lalvini discloses a large variety of nodal, periodic and non-periodic, space-frame and panel structures based upon 'golden polyhedra' and distortions thereof. The most relevant of these are called 'saddle zonogons' and 'saddle zonohedra' derived from the radial folding or skewing of plates. Such modules are similar to some of those disclosed by Pearce and suffer from the same disadvantages indicated above.

OBJECTIVES OF THE INVENTIONS

The objective of the invention is to provide a simple modular construction panel which can be assembled into sheets or structures with integral structural strength and yet be suitable for mass production and transport. More generally, it is the object of the invention to provide an improved modular construction panel, and panel-sheets, structures and construction systems based thereon.

OUTLINE OF THE INVENTION

The present invention is based upon the realisation that combined cladding and structural modules can be constructed by bracing radially pleated and dished polygonal plates on their concave sides, either with a bracing 'spider' or with a second polygonal plate of substantially the same shape and pleated form as the first plate, the two plates being with their concave faces together. In this context, 'pleating' means that ridges and valleys alternate around the polygonal plate and that, therefore, the polygon must have an even number of sides. Particularly suitable polygons for such modules in profile are those of a rectangle (including a square), and a regular hexagon or octagon, the hexagon being preferred (though the invention is not limited to either shape). A module formed from two pleated plates in the manner indicated will be light-weight, stiff and hollow, but it can be further strengthened by securing the sides together by plastics foam, by the use of internal pillars or webs, or by in-pleating to dimple the plates (even to the degree that their centres touch).

Such modules (when viewed side-on) will have undulating edges as their adjacent edges will be angled to one another by less than the normal angle for the respective regular polygon. For example, the angle between two adjacent sides of a hexagonal module (when viewed from the edge of the module) will be less than 120° though the angle of the same to sides viewed in projection from the face of the module will be 120°. The first angle is called the 'edge angle' of a module. Provided modules have the same edge angles they can be joined together by their edges to form panels (which extend in essentially two dimensions). The joining of one module to another may be effected in any one of many ways known in the art, but this will usually be achieved by using flanges formed around the periphery of each module for the purpose. When the flanges extend in-line with the plane of the module, one row of modules in a panel may overlap the next like roof-tiling to facilitate weather-proofing. When the flanges are turned at right angles to the plane of the module, they can be readily welded, glued, clipped, riveted, stitched or bolted together.

Joining strips may also be employed. Of course, the orientation of the flanges between adjacent plates and the method of joining the flanges and plates will depend to some degree upon the material of the plates. Since modules formed from two plates are hollow, they can be filled with plastics foam or the like to improve rigidity and insulation properties.

Any suitable stiff sheet material may be used for the plates, examples being plastic, metal, cellulose card, reinforced cement/concrete or fibre-board. The plates may be profile-cut in any suitable manner, as by laser-cutting, blanking or guillotining and may be pleated by folding, creasing or pressing. It is also envisaged that plastics, cellulose or fibre-board plates could be formed in a hot pressing operation, while metal plates could be stamped-out in one operation. As the modules need not be large (ie, meters across), they can be easily mass-produced and transported in finished form or as stacks of pleated plates (or spiders) ready for assembly.

It should be noted that, in order to form a module which is a regular polygon (in projection) the blank for a plate cannot be a regular polygon. Those pleat-lines which form ridges will be shorter than those which form valleys, the difference in their lengths determining the depth of pleating and the thickness of the module. The ratio of the lengths of a valley to a ridge of a blank (or plate) is an important parameter and is called the 'pleat ratio'. This ratio determines the depth of pleating (or the thickness of the module), and the edge angle and, thus, the degree of dimpling of the surface of a panel. This, in turn therefore, determines the minimum angle at which a panel can be disposed to the horizontal before puddling occurs in the dimples during rain. It also determines the non-zero (or non-180°) 'transition angle' at which one panel will join to another 'naturally' without the need for corner modules (here-after called sub-modules). For example, a pleating ratio of 1.05 allows a transition angle of 120° (included angle) between two panels formed from hexagonal modules, while a pleating ratio of 1.18 allows a transition angle of 90° for similar panels.

Thus, the principal terms used in this specification are as follows:

'Module' indicates a braced and pleated polygonal plate, the bracing by the use of a spider or (more preferably) by the use of a second pleated plate.

'Plate' indicates a sheet of material of polygonal shape (usually rectangular, hexagonal or octagonal) which is radially pleated to form a component of a module, an un-pleated plate being referred to as a 'blank'. A bracing plate need not be continuous as portions of its blank can be cut away to reduce its weight to create (for example) a spider-like lattice of triangles.

'Spider' indicates a star-shaped structure used for bracing a pleated plate to complete a module.

'Panel' indicates a plurality of modules assembled edge to edge to form a generally planar (two-dimensional) array. A panel may, for example, form the wall or roof of a hut (or part thereof).

'Structure' indicates at least two panels assembled at an angle to one another and is, therefore, three dimensional in character. A structure may be, for example, a gabled roof, an arch or a hut.

DESCRIPTION OF EXAMPLES

Having broadly portrayed the nature of the present invention, particular embodiments will now be described by way of example and illustration only. In the following description, reference will be made to the accompanying drawings in which:

FIG. 1A illustrates the manner in which a hexagonal module is formed from a pair of plates, while

FIG. 2A illustrates the manner in which an octagonal module is formed from a pair of plates, while

FIG. 3A is an elevation of a vertical panel formed from hexagonal modules, FIG. 3B being a sectional elevation taken on plane 3—3 of FIG. 3A, while

FIG. 4A is an elevation of a vertical panel formed from octagonal modules, FIG. 4B being a sectional elevation taken on plane 4—4 of FIG. 4A, while

FIG. 5A is a plan view of a horizontal panel formed from hexagonal modules which overlap one another in the manner of roof tiling, while

FIG. 6A is a diagrammatic sectional elevation of a panel showing one way of joining the modules, while

FIGS. 7A–7C are cross-sections of modules which have been internally strengthened in various ways, while

Figure 8A:
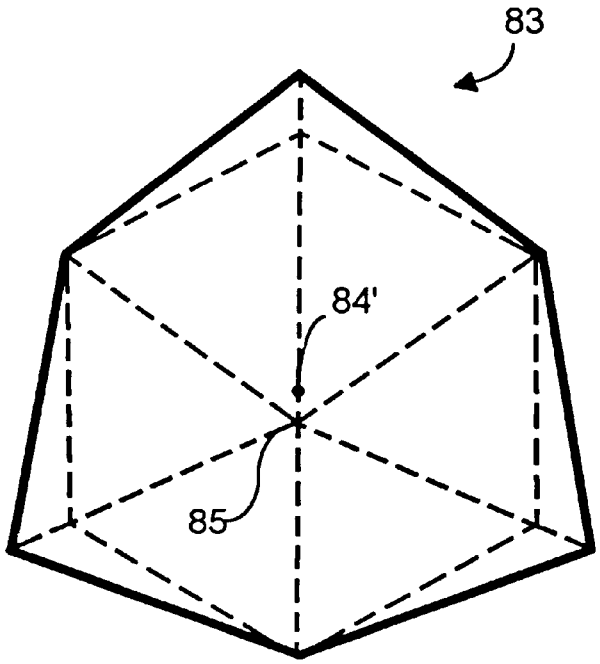
Figure 8B:
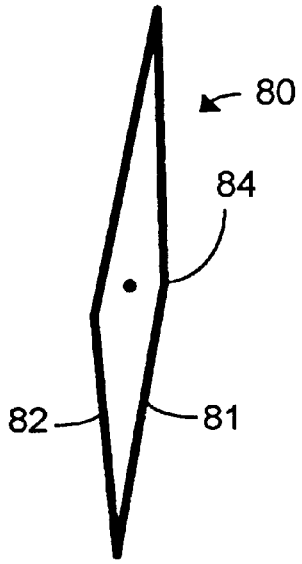
Figure 8C:
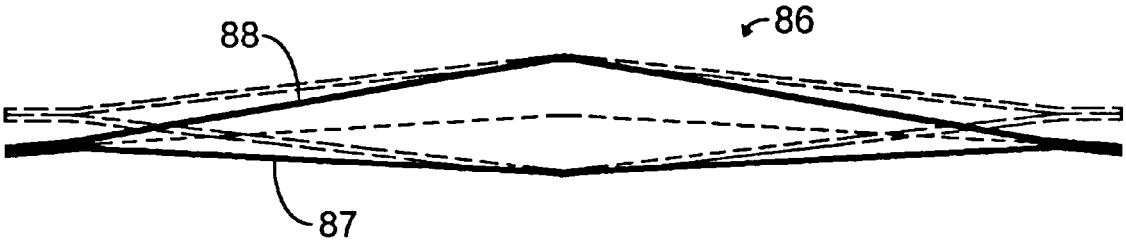

FIGS. 8A–8C shown modules which are adapted to generate curved panels, FIG. 8A being a plan view of a plate blank modified for the purpose, FIG. 8B being a diagrammatic section of a module formed from two plates formed from blanks of the type shown in FIG. 8A.

FIGS. 9A–9D show the manner in which two panels may be joined along their saw-tooth edges at their characteristic transition angle, each Figure being a perspective view of a panel or panels.

Figure 10A:
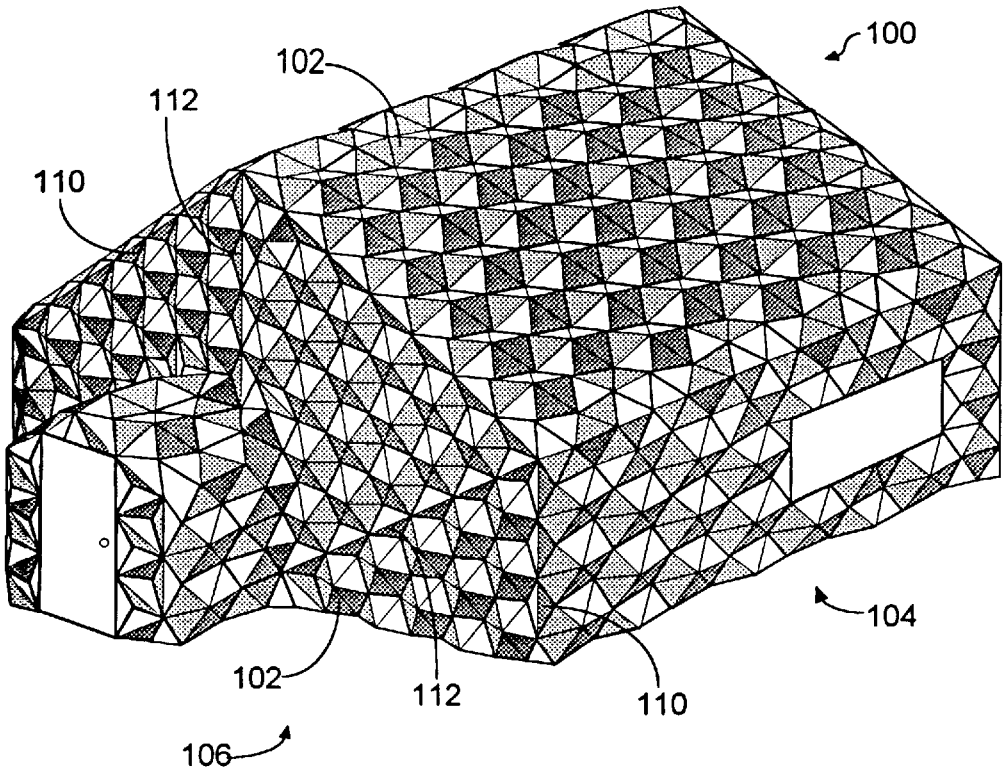
Figure 10B:
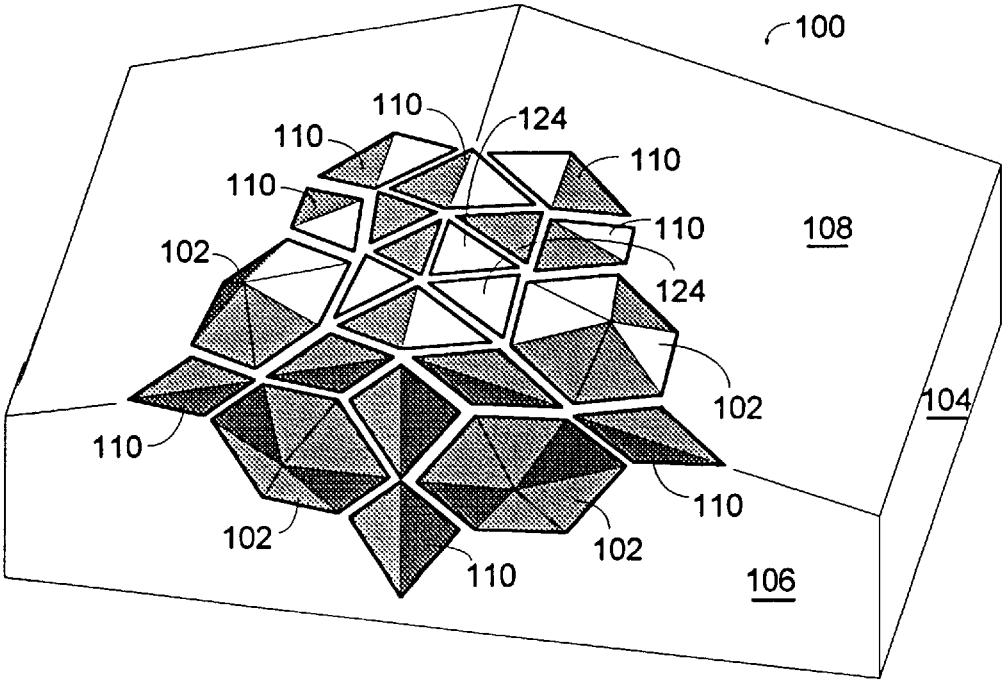

FIG. 10A is a diagrammatic perspective of a hut or shed having its walls and roof formed from hexagonal modules, while FIG. 10B is an enlarged and simplified semi-exploded view of the gable peak of the hut or shed of FIG. 10A.

Figure 11:
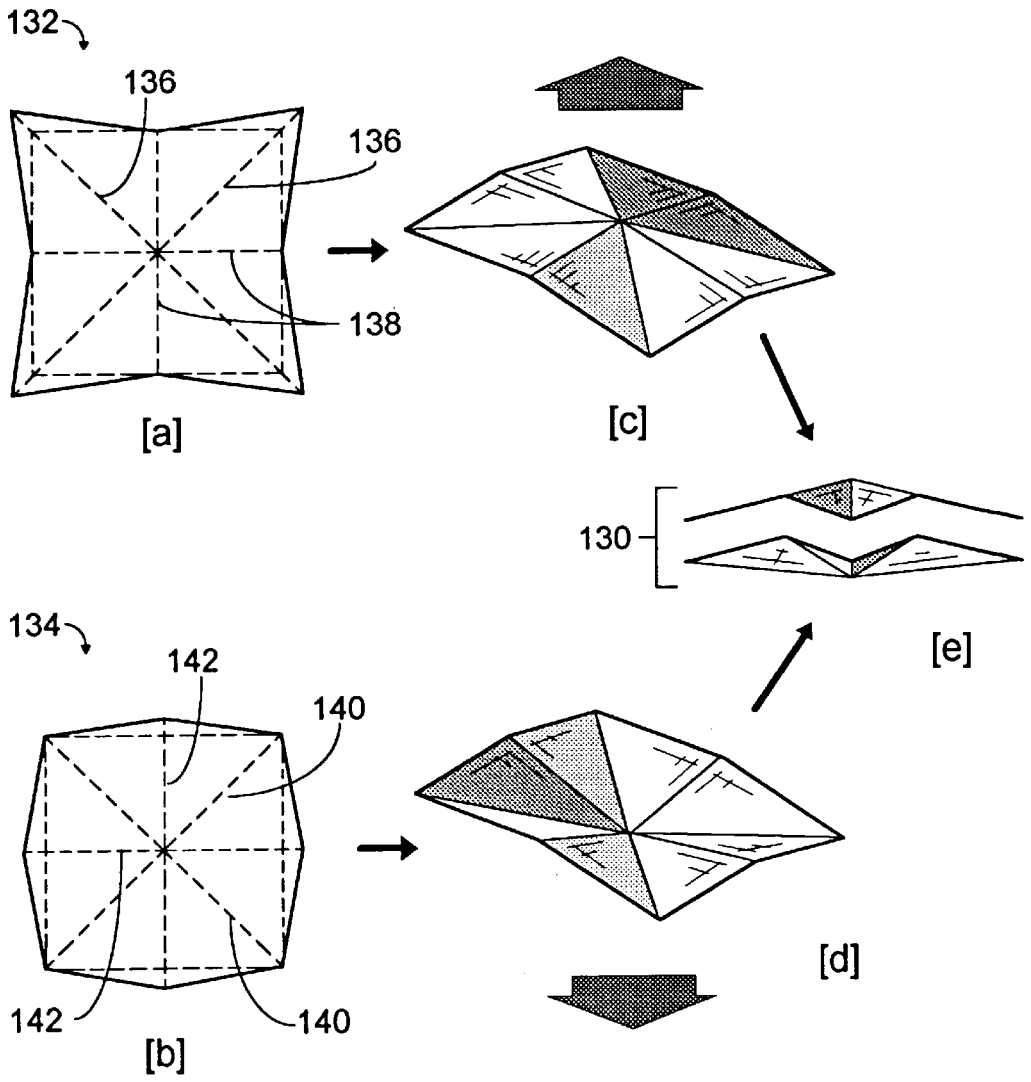

FIG. 11 illustrates the manner in which a square module is formed from a pair of different but substantially square pates.

Figure 1A:
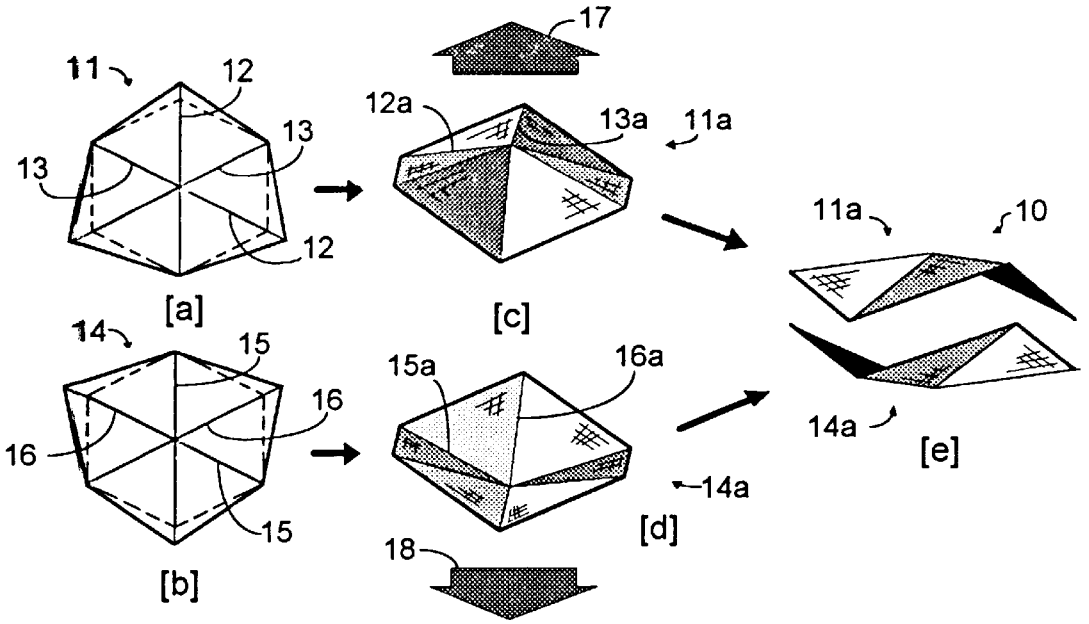

One way in which a hexagonal module 10 may be formed in accordance with this invention is illustrated by FIG. 1A in drawings [a] to [e]. A first plate 11 or blank is cut to a particular hexagonal shape from stiff sheet material (drawing [a]), the shape generally being a distortion of a regular hexagon (indicated in broken lines) in that each alternate 'radius' (semi-axis or half-diagonal) 12 is lengthened, leaving the other radii (13) unchanged. A substantially identical second plate 14 is formed in the same manner (drawing [b]) but is rotated 60° with respect to plate 11 so that its shorter radii 15 are aligned with the longer radii 12 of plate 11 and its longer radii 16 are aligned with the shorter radii 13 of plate 11. First plate 11 is then pleated (eg, by folding or pressing) so that its lengthened radii (12) form valleys 12*a* and its normal radii form ridges 13*a,* forcing the plate into a dish-shape with its convex side uppermost, as indicated by arrow 17 in drawing [c]. The pleated first plate is indicated at 11*a* in drawings [c] and [e]. Plate 14 is similarly pleated to form valleys 16*a* and ridges 15*a,* forcing it to adopt a concave shape with its convex side lower-most, as indicted in drawing [d] by arrow 18. The pleated second plate is indicated at 14*a* in drawings [d] and [e]. Note that the designation of which radii is a valley and which is a ridge is determined by viewing each plate from its convex (lower) side, but that however viewed, ridges and valleys alternate around the hexagonal shape. Finally, pleated plates 11*a* and 14*a* are juxtaposed with their concave faces together and the ridges 13*a* of the first opposite the valleys 16*a* of the second. When these plates are brought together so that their peripheries are coincident and secured together, they form the module 10 which has undulating edges as shown in drawing [e]. However, in projection, module 10 has the shape of (but is slightly smaller in size than) the regular hexagon indicated in broken lines in drawings [a] and [b].

Figure 1B:
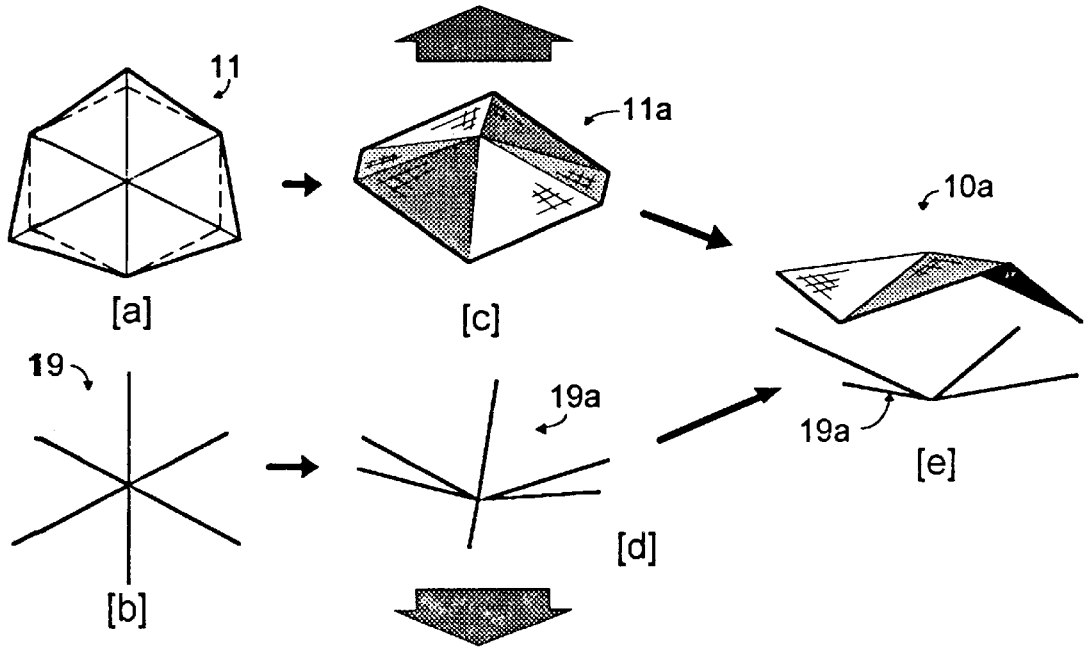
FIG. 1B shows the formation of a hexagonal module from a plate and a spider.

Another way of forming a hexagonal module 10*a* is shown in drawings [a] to [e] of FIG. 1B, upper pleated plate 11*a* being identical to the first plate of FIG. 1A (and being referenced accordingly). Instead of using a second plate to brace the first, this function is performed by a star-shaped spider shown as a flat blank 19 in drawing [b] of FIG. 1B. Spider 19 may be bent to form a dished spider 19*a* (drawings [d] and [e] and assembled with plate 10*a* so that the ends of its arms connect to the corners of pleated plate 11*a*. It will be appreciated, however, that the spider can be formed so that it remains flat rather than dished and so that it has only three arms rather than six. In the latter case, it is desirable to ensure that the arms of the spiders of two adjacent modules do not meet at the same plate corners; that is, to ensure that the spider of one module assists in the bracing of an unbraced corner of a neighbouring module.

Figure 2A:
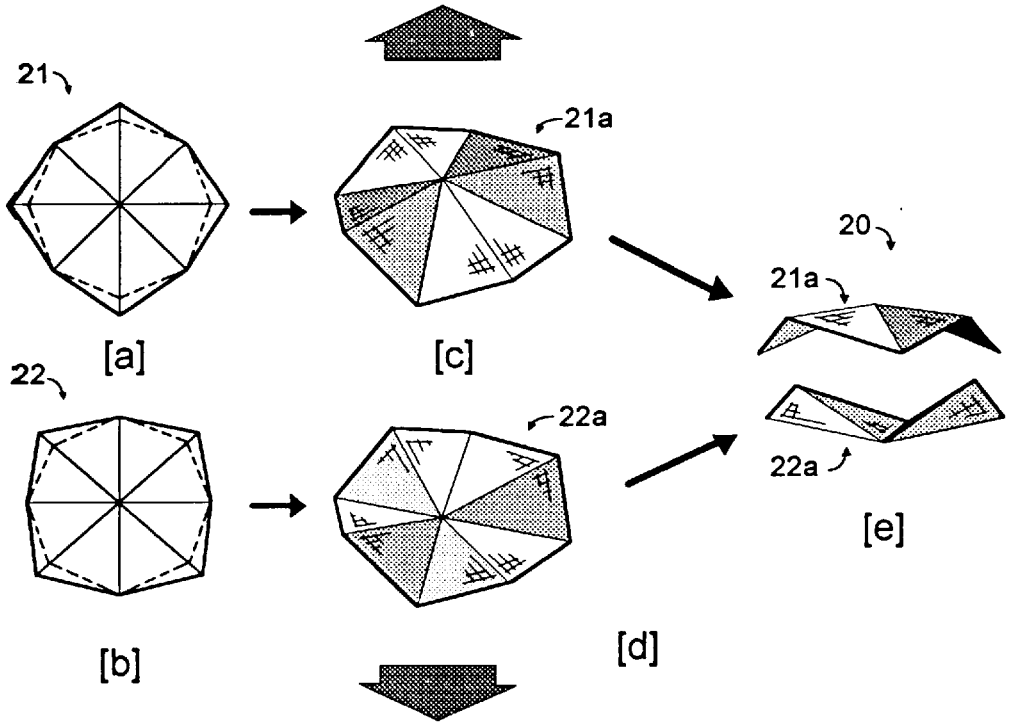

FIG. 2A illustrates the way in which an octagonal module 20 (drawing [e]) may be formed from a pair of flat blanks 21 and 22 of generally octagonal shape in which every alternate radius has been lengthened (see drawings [a] and [b]). As before, each lengthened radius forms a valley and each normal radius forming a ridge in the corresponding pleated and dished plates 21*a* and 22*a* (see drawings [c] and [d] respectively). Once again, the pleated plates are juxtaposed so that the ridges of one are opposite the valleys of the other (see drawing [e]) and are brought together so that their peripheral edges coincide and are joined together creating module 20. Module 20, when viewed side-on, has undulating edges. In projection, it has the shape of (but is slightly smaller in size than) the regular octagon indicated in broken lines in drawings [a] and [b].

Figure 2B:
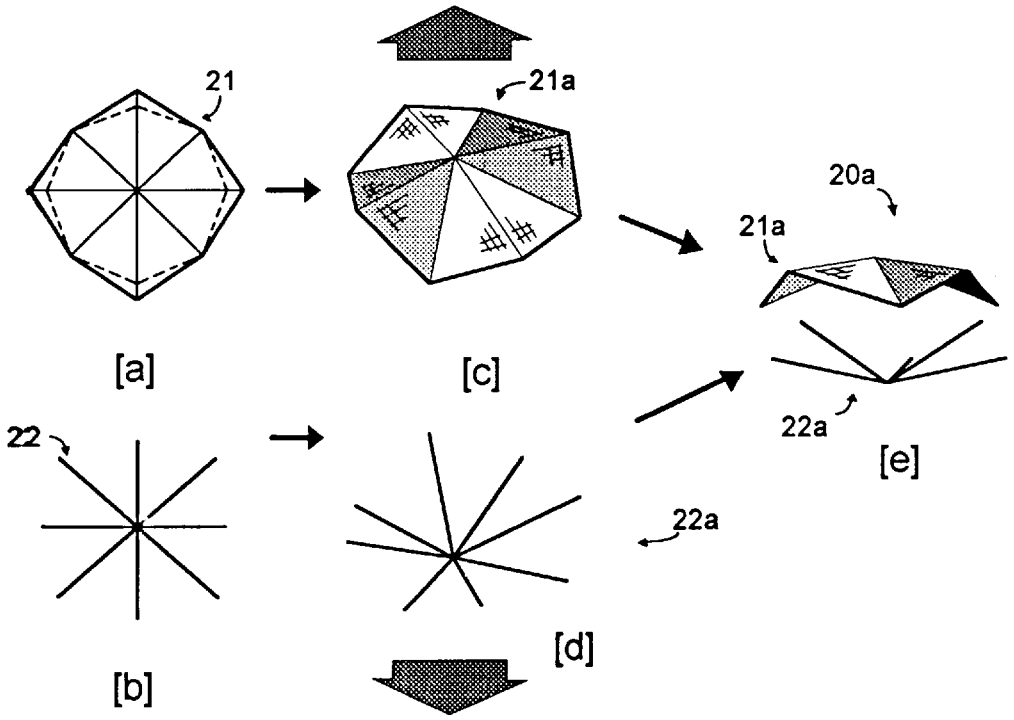
FIG. 2B shows the formation of an octagonal module from a plate and a spider.

Like the hexagon example, an octahedral module 20 can be formed using a spider, as shown in the drawings [a] to [e] of FIG. 2B. The first or upper blank 21 and pleated plate 21*a* are identical with those of FIG. 2A. However, in this case, instead of the six-legged spider of FIG. 1B, an eight-legged spider 22 is shown as a flat 'blank' in drawing [b]. This blank is bent to form the dished spider 22*a* which is assembled with plate 21 a to form the bracing of module 20*a*. As indicated with respect to the hexagonal case, there is no need to dish the spider and half of its legs may be omitted without significant loss of bracing effect.

Figures 3A, 3B:
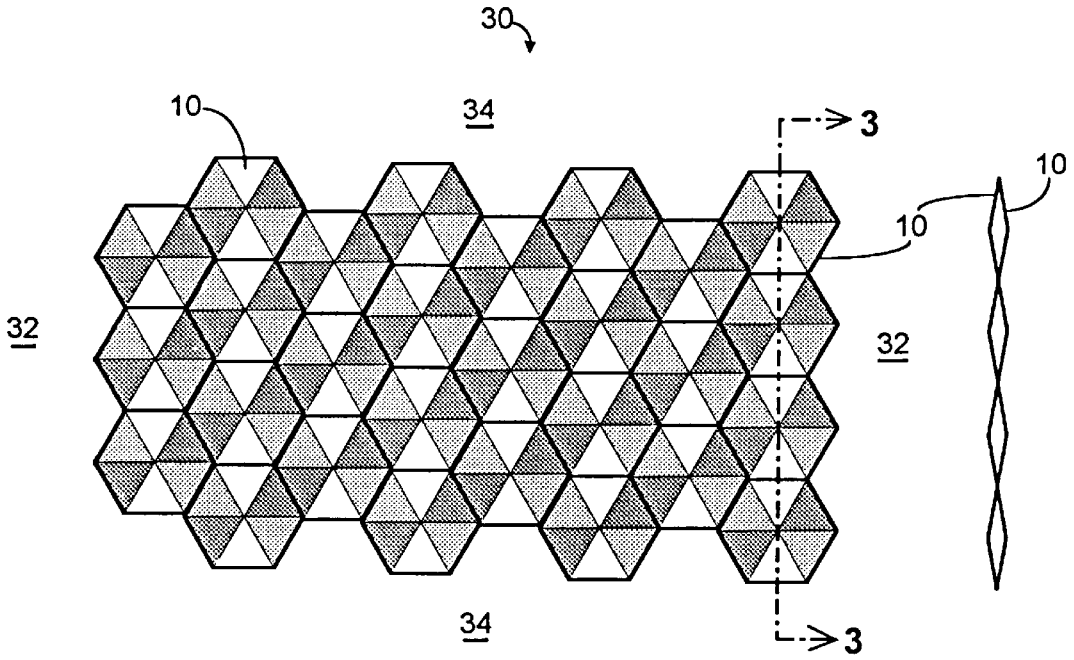
Figure 3C:
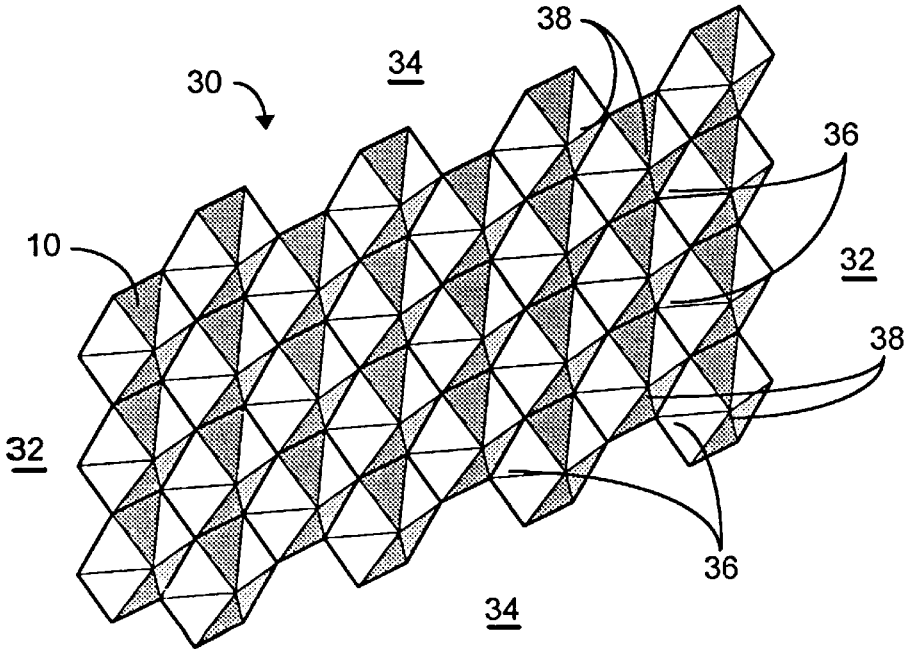
FIG. 3C is a perspective view of the panel of FIG. 3A.

Turning now to FIGS. 3A to 3C which illustrate a substantially rectangular panel 30 formed from hexagonal modules 10 (or 10*a*) described above. It will be seen that one pair of opposing panel edges (32) are of saw-tooth shape and that the other pair of opposing edges (34) are of castellated shape. Because of the undulating character of the edges of each module 10, a grid of depressions or dimples 36 are formed at the junctions between three adjacent modules and a corresponding grid of bumps 38 are formed by the apices of the modules (FIG. 3C).

Figure 4A:
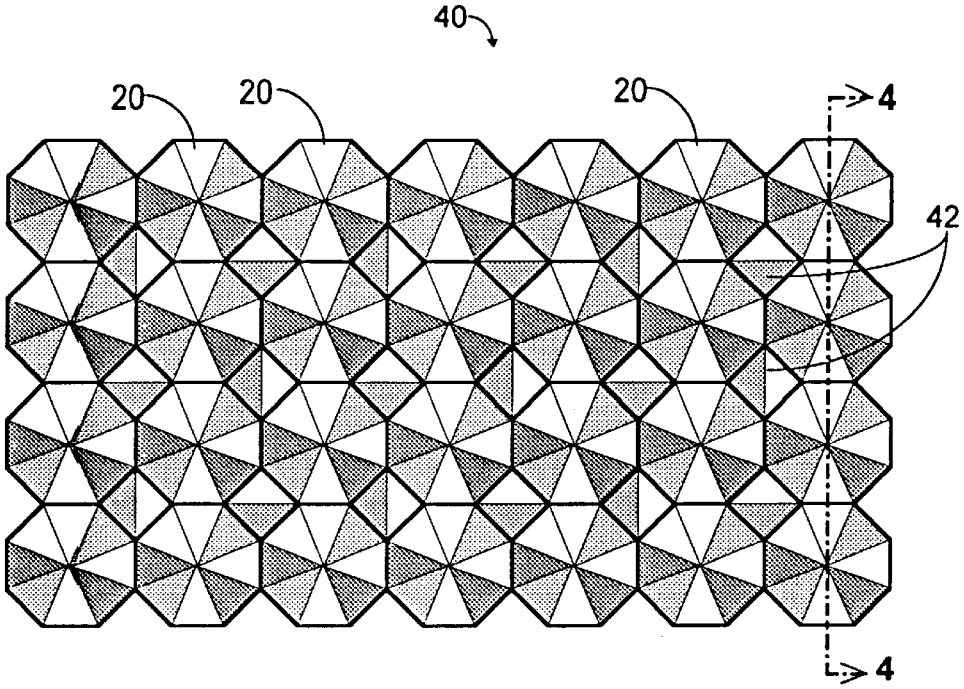
Figure 4B:
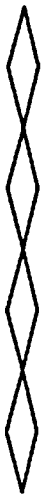
Figure 4C:
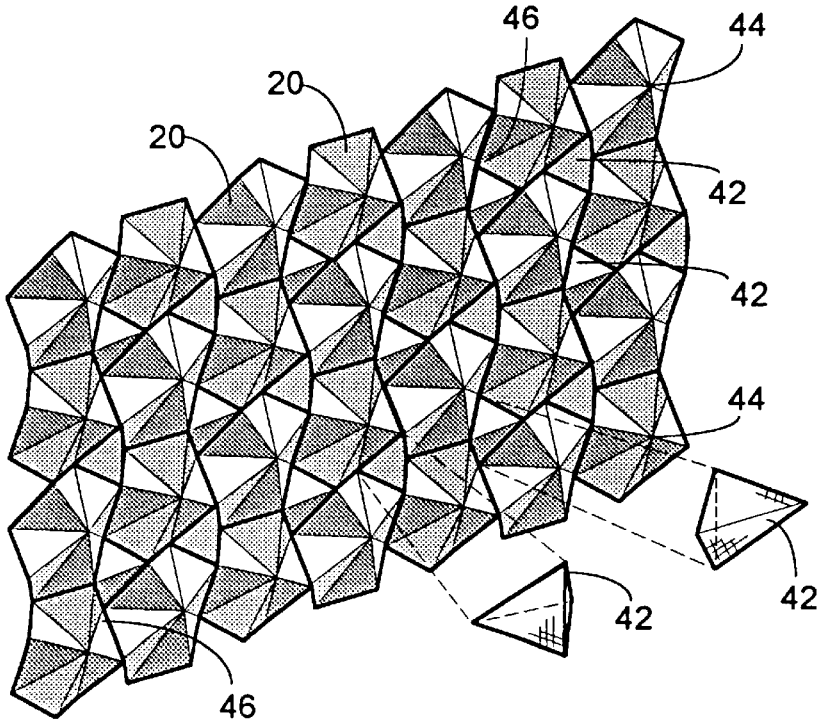
FIG. 4C is a perspective view of the panel of FIG. 4A.

FIGS. 4A–C show a substantially rectangular panel 40 of octagonal modules 20 and tetrahedronal sub-modules 42, the latter modules being referred to as sub-modules as they are of lesser significance from the standpoint of this invention. It will again be seen that the centres of the octahedral modules 20 form a grid of bumps 44, while the junctions between 20 and 42 form a corresponding grid of dimples or depressions 46.

Figure 5A:
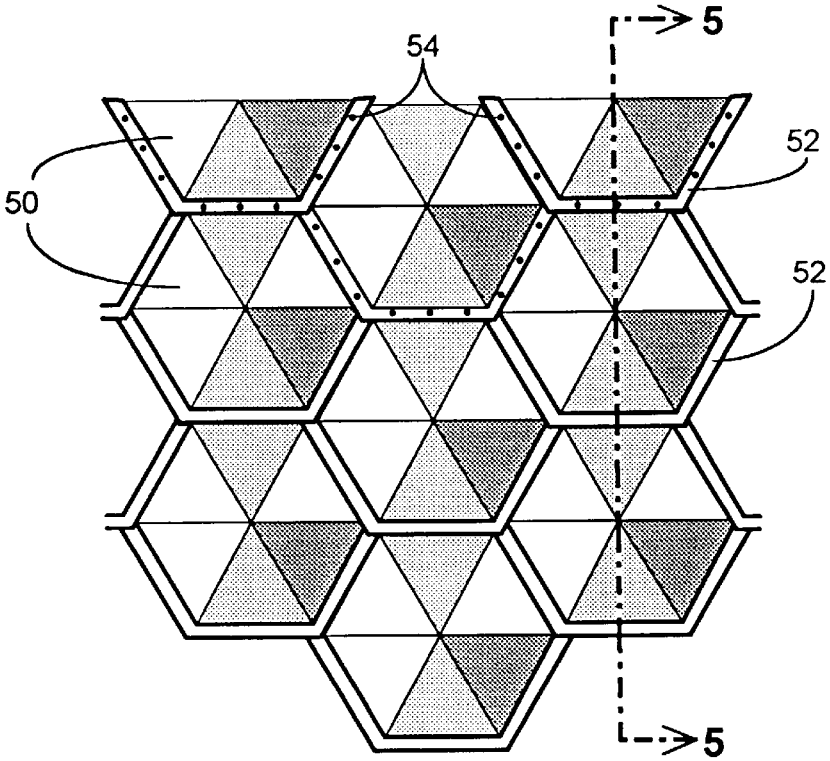
Figure 5B:
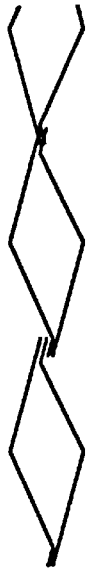
FIG. 5B is a diagrammatic sectional elevation of the panel of FIG. 5A taken on plane 5—5.
Figure 6A:
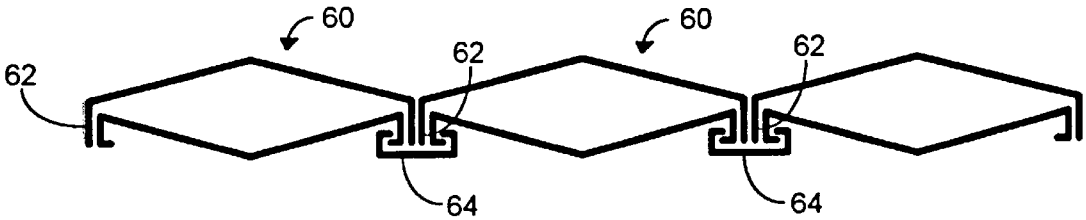
Figure 6B:
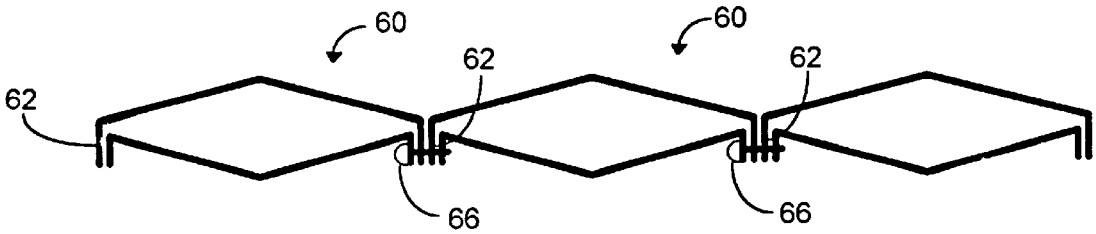
FIG. 6B is a similar view showing another way of joining the modules.

FIGS. 5, 6 and 7 show various methods of joining hexagonal modules. In FIG. 5A and 5B each module 50 is formed with a continuous peripheral flange 52 so that the modules can be arranged in horizontal rows with one edge horizontal, so that the lower edge or flange 52 of each module 50 overlaps the upper edge or flange of the next lower module, as in the case of roof-tiling. The modules may be secured together by rivets, screws, clips or bolts generally indicated at 54. Alternative methods of joining adjacent modules are indicated by FIGS. 6A and 6B. In these examples, each module 60 is formed with edge flanges 62 which are bent at right angles to the plane of the module. In the case of FIG. 6A, flanges 62 are provided with a return lip so that adjacent modules can be joined together by U-shape clips or strips 64 which can be spot-welded, glued, bolted or simply slid in place. In the case of FIG. 6B, the flanges 62 are secured together by fasteners 66.

Figure 7A:
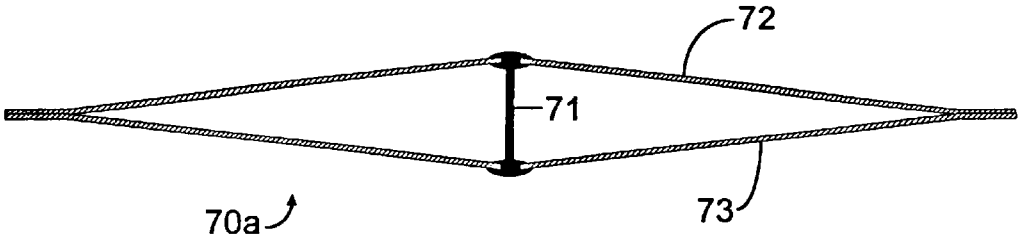
Figure 7B:
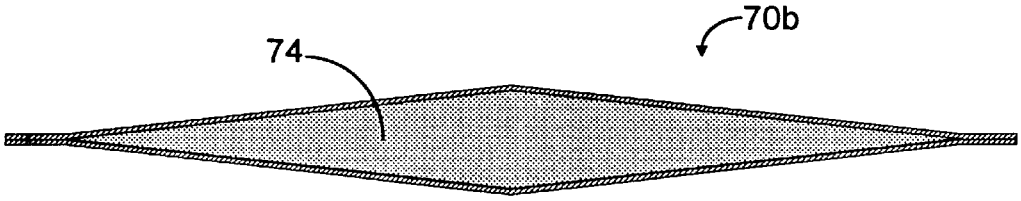
Figure 7C:
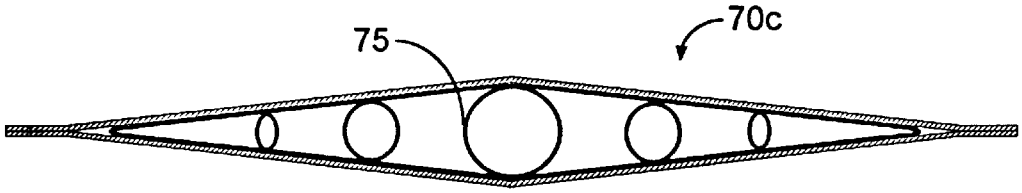
Figure 7D:
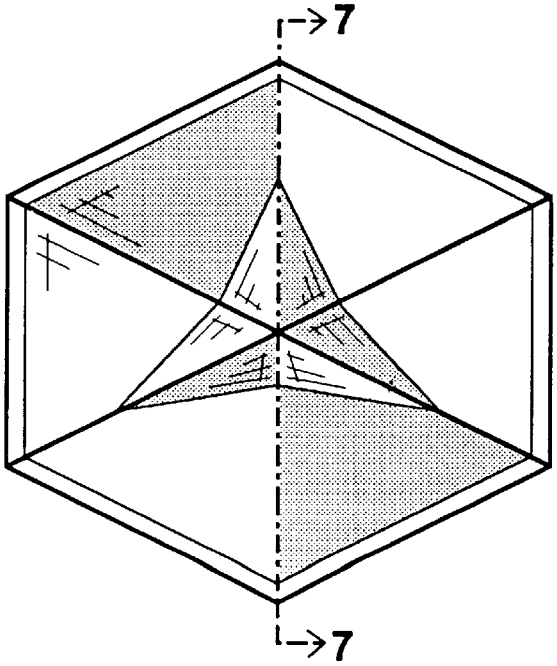
FIG. 7D is a plan view of a module strengthened by secondary pleating or dimpling, FIG. 7E being a section of the module of FIG. 7D taken plane E—E of FIG. 7D.
Figure 7E:
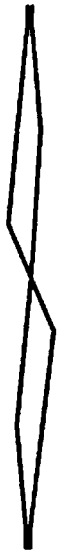

While the structural rigidity of a module or a panel depends upon the strength and the stiffness of the sheet material from which the plates are formed, as well as upon the manner in which they are joined together, the stiffness of a module can be enhanced in a number of ways. Some of these are illustrated in FIGS. 7A to 7E. In FIG. 7A, a module 70*a* (shown in section) is strengthened by the use of a central post 71 which extends between the apices of the plates 72 and 73 and is riveted at each end to the respective plate. In FIG. 7B, module 70*b* (also shown in section) is filled with a solid light-weight plastics foam 74 (such as polyurethane), to effect the reinforcement. In FIG. 7C, module 70*c* is fitted with an internal stiffening web 75, but it is also envisaged that a cruciform (or star-shape) web assembly may be used so that the module 70*c* is stiffened along more than one axis. Finally, according to the general principle shown in FIGS. 7D and 7E, a module 70*d* may be stiffened by secondary in-pleating each plate to invert its apex and form a dimple 76. While it is not essential for the dimples to be star shaped, have facets or for their centres to touch, these features are shown in the drawings and provide excellent stiffening of the module 70*d*. The radiating points of each dimple may be arranged on the ridge-pleats of the plate. The centres of dimples 76 may, of course, be secured together by a suitable fastener, further strengthening the module.

It is possible to form spherically or cylindrically curved panels by suitable modification of their component modules. In general, this is achieved by forming each module from a pair of blanks which differ slightly. For example, one blank may have a different pleating centre and/or a slightly different shape with respect to the other. The first is illustrated in the example of FIGS. 8A and 8B, the second in FIG. 8C.

The module 80 of FIG. 8B is formed from plates 81 and 82, the blank 83 for plate 82 being shown in FIG. 8A. Plate 81 is formed normally; that is, its pleating centre and the polygon centre of its blank (not shown) coincide at 84. However, the pleating centre 85 of blank 83 is offset with respect to its polygonal centre (84'). When a panel is assembled from modules 80 which are aligned so that their offset pleating centres (85) are similarly disposed relative to the panel, a cylindrically-curved panel will be produced; offsetting of the pleating centres of a module being the basis of cylindrical curvature in a panel.

To obtain spherical curvature in a panel, the modules may also be constructed as illustrated by module 86 in FIG. 8C. That is, one plate 87 of each module is also cut slightly smaller than the other plate 88 so that, when the module is assembled, it is distorted when the edges of the two plates are brought into alignment and fastened.

Planar panels may be joined at angles to form three-dimensional structures in a variety of ways, the most versatile being to use sub-modules which have the same edge angles as the panel modules and which effect the 'turn'. In the case of hexagonal modules, the use of such sub-modules is illustrated in FIGS. 10A and 10B, which show that it is possible to construct and entire hut or shed (with gabled roof) from panels with hexagonal modules joined with tetrahedronal sub-modules.

Figure 9A:
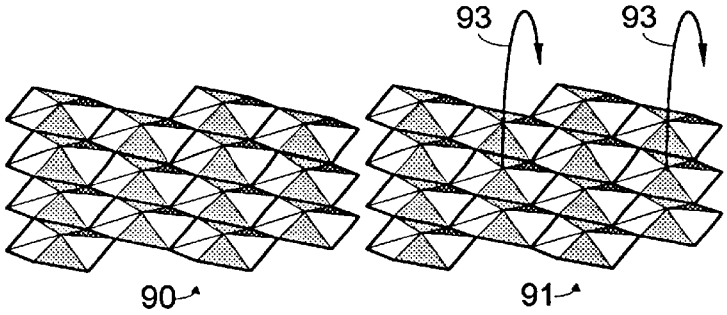
Figure 9B:
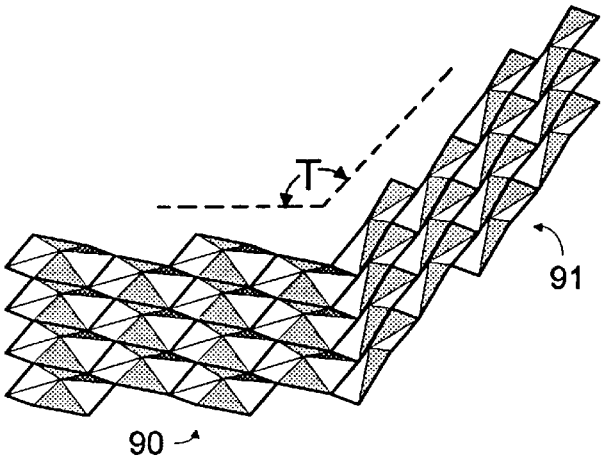
Figure 9C:
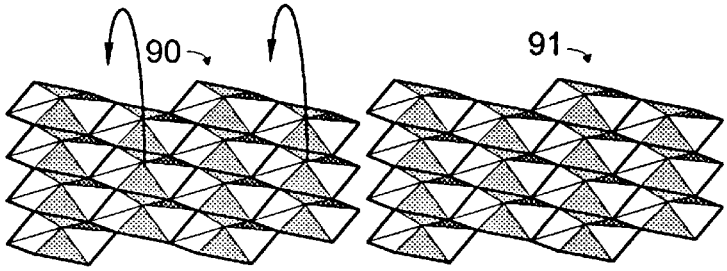
Figure 9D:
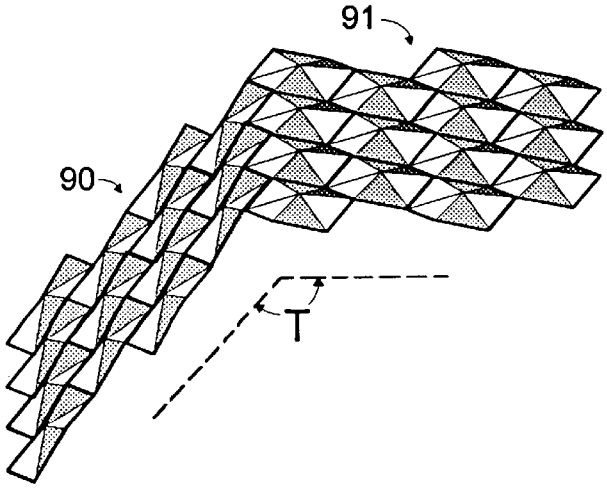

To form three dimensional structures by joining planar panels of hexagonal modules along their edges, use can be made of the natural 'transition angle', T of the panels to be joined (provided they have been formed from modules of the same size and pleat ratio). This is illustrated by FIGS. 9A–9D. In FIG. 9A, the two panels 90 and 91 to be joined at an angle are arranged with their saw-tooth edges toward one another (as if they had just been separated). Panel 91 is then turned up-side-down (as indicated by arrow 93) and the two panels brought together so that the undulating edges of the modules forming the saw-tooth edge are aligned and in contact. When this occurs, the panels will be at an angle as shown in FIG. 9B, the angle being the transition angle T corresponding to the component pleating ratio of the component modules. If, as shown in FIG. 9C, panel 90 is turned instead of panel 91 and the two are brought together in the same manner, they will still be arranged at angle T, but the joint will be inverted, as shown in FIG. 9D.

Mathematical analysis shows that, for hexagonal modules, the two practically important transition angles of 90° and 120° correspond to pleat ratios of 1.18 and 1.05, but any desired transition angle can be set by suitably adjusting the pleat ratio of the component modules of a panel. FIGS. 10A and 10B show a shed such as a glass-house 100 formed entirely from hexagonal modules 102 with a pleating ratio of 1.05, but without any 'natural' transitions between panels. The saw-tooth to saw-tooth join between the side wall panel 104 and front wall panel 106, as well as the transition between the roof panel 108 and the front wall panel 106, are effected by the use of tetrahedrons 110 designed to match the edge angles of the modules and to effect the necessary turns. To align the front wall modules with the roof angle (the included ridge angle being 120°), a row of tetrahedron modules 112 must also be used. These extend diagonally downwards from the roof-wall junction as shown.

The junction between the side wall and the roof panels involves a castellated edge to a castellated edge and this junction may be effected by both tetrahedrons and right pyramids or equilateral triangles. Given the geometry of the shed, it will be seen that the wall-to-roof angle is the same as the gable angle (ie, 120°). Therefore, to illustrate the joint more clearly (and to show how the pinnacle join is accomplished, FIG. 10B shows the arrangement of modules in an enlarged and simplified manner. In this Figure, the hexagonal modules are shown at 102, the tetrahedral modules are shown at 110 and the triangular or right-pyramidal modules are shown at 124. In the structure shown, based on hexagonal modules with a pleat ratio of 1.05, a total of only five different blanks (for the hexagonal modules, two types of tetrahedronal sub-modules, and triangles) are required to effect the entire construction.

Finally, FIG. 11 illustrates the form of a square module 130 FIG. 11[*e*]) and the way in which it is formed from two slightly different plates 132 and 134. Plate 132 (FIG. 11[*a*]) is pleated so that its diagonals 136 form valleys and its right bisectors 138 form ridges (FIG. 11[*c*]). Thus, consistent with the hexagonal plates described in the above examples, the four sides of plate 132 are distorted by lengthening the diagonals. On the other hand, plate 134 (FIG. 11[*b*]) is pleated so that its diagonals 140 form ridges and its right bisectors 142 form valleys (FIG. 11[*d*]. Again, consistent with the hexagonal plates described in the above examples, the four sides of plate 134 are distorted by lengthening the right bisectors. These pleated plates are then assembled with valleys opposing ridges as illustrated in FIG. 11[*e*]. Panels and structures may then be formed from modules 130. It will be appreciated that the same principles can be applied to the formation of non-square rectangular modules.

It will be appreciated that the examples of the invention described above meet the objects and advantages set out at the beginning of this specification. However, those skilled in the art will also understand that many variations and modifications can be made to the invention as disclosed without departing from the scope of the following claims.

I claim:

1. A polygonal constructional module having a shape in outline selected from the group comprising rectangles, squares, hexagons and octagons, said module comprising:

a first plate of polygonal shape having a center, a peripheral edge, a plurality of corners spaced around said peripheral edge and having a first side surface and a second side surface opposite said first side surface, pleats extending from said corners toward the center of said first plate to form alternating ridges and valleys around said first plate thereby causing said first plate to be dished so that said first side surface is concave and said second side surface is convex, a second plate of polygonal shape having a center, a peripheral edge, a plurality of corners spaced around said peripheral edge of said second plate and having a first side surface and a second side surface opposite said first side surface of said second plate, and pleats extending from said corners of the second plate toward the centre of the second plate to form alternating ridges and valleys around said second plate thereby causing said second plate to be dished so that said first side surface of the second plate is concave and said second side surface of the second plate is convex, and wherein said first and second plates are aligned, superimposed and joined at their respective peripheral edges so that (i) their concave side surfaces face one another and enclose a space there-between, and (ii) at least one of the ridges on the concave side surface of said first plate is aligned with at least one of the valleys on the concave side surface of said second plate.

2. The module of claim 1 wherein:

each ridge of the concave side surface of said first plate is aligned opposite a respective valley of the concave side surface of said second plate, the length of each valley of each plate is greater than the length of each ridge of the respective plate, the ratio of the length of each valley to the length of each ridge in one of said plates is the same as the ratio of the length of each valley to the length of each ridge in the other of said plates, and wherein the module thus formed has an undulating peripheral edge.

3. The module of claim 2 wherein the module has a hexagonal shape and said ratio is 1.05.

4. The module of claim 2 wherein the module has a hexagonal shape and said ratio is 1.18.

5. The module of claim 2 wherein the ridges and valleys of each plate converge at the center of the respective plate.

6. The module as claimed in claim 2 wherein the ridges and valleys of each plate converge at a point displaced from the center of the respective plate, thereby imparting a cylindrical curvature to the module.

7. The module as claimed in claim 2 wherein said second plate is smaller than said first plate, thereby imparting a spherical curvature to the module.

8. The module as claimed in claim 2 wherein a dimple is formed in the center of the convex side surface of at least one of said plates thereby increasing the rigidity of the module.

9. A planar panel comprising a plurality of interconnected modules formed in accordance with clamp 2 wherein:

the panel has a first side face and a second side face, each of said panel side faces has a regular pattern of depressions formed therein by the junction of the valleys in the convex second side surfaces of the plates of adjacent modules, and each of said panel side faces has a regular pattern of mounds formed thereon by the junction of the ridges of adjacent modules.

10. The panel of claim 9 wherein:

the panel is of a substantially rectangular shape and has two pairs of opposing edges, and each edge of one pair of said opposing edges of the panel is of saw-tooth shape, each edge of the other pair of said opposing edges of the panel is of castellated shape.

11. The panel claimed in claim 10 wherein:

each of said modules is of hexagonal shape, and a plurality of tetrahedronal sub-modules are joined to the hexagonal modules of the panel along at least one of said panel edges which is of saw-tooth shape.

12. The panel claimed in claim 9 wherein:

the panel is formed from a plurality of adjacent rows of said modules, each row of modules having a first longitudinal edge and a second longitudinal edge, and wherein said first longitudinal edge of one of said rows of modules overlaps said second edge of an adjacent row of modules.

13. The panel claimed in claim 9 wherein:

tabs are formed on the peripheral edges of at least one plate of each module so as to extend at an angle with respect thereto, and fastener means are employed to secure the tabs of adjacent modules together to form the panel.

14. A panel wherein:

said panel is formed from a plurality of modules of octagonal shape formed in accordance with claim 2 and a plurality of sub-modules of tetrahedronal form, said octagonal modules and said sub-modules are joined together to cover a planar area so that said panel has a first side surface and a second opposing side surface and a plurality of side edges, and each of said side surfaces of the panel has a regular pattern of depressions therein formed at junctions of said octagonal modules and said sub-modules.

15. A three-dimensional structure created by joining a plurality of panels formed as claimed in claim 11, wherein:

a first one of said panels is joined along one of its edges of saw-tooth shape to the edge of a second panel which is also of saw-tooth shape in such a manner as to leave no gaps, and said first and said second panels are arranged at an angle to one another.

16. A three-dimensional structure comprising a first panel formed as claimed in claim 14 joined by one side edge thereof to one side edge of a second panel also formed as claimed in claim 14, so that said first panel is arranged at an angle to said second panel, and wherein:

sub-modules having the shape of tetrahedrons are employed to join said one side edge of the first panel to said one side edge of said second panel.

* * * * *